US011313170B2

(12) United States Patent
Delcides-Borges

(10) Patent No.: US 11,313,170 B2
(45) Date of Patent: Apr. 26, 2022

(54) SHIMMING DEVICE AND METHOD OF USE

(71) Applicant: Pedro Delcides-Borges, San Pablo, CA (US)

(72) Inventor: Pedro Delcides-Borges, San Pablo, CA (US)

( * ) Notice: Subject to any disclaimer, the term of this patent is extended or adjusted under 35 U.S.C. 154(b) by 0 days.

(21) Appl. No.: 17/024,197

(22) Filed: Sep. 17, 2020

(65) Prior Publication Data

US 2022/0081956 A1 Mar. 17, 2022

(51) Int. Cl.
*E06B 1/60* (2006.01)

(52) U.S. Cl.
CPC ..... *E06B 1/6069* (2013.01); *E06B 1/6038* (2013.01)

(58) Field of Classification Search
CPC ..... E06B 1/6038; E06B 1/6069
See application file for complete search history.

(56) References Cited

U.S. PATENT DOCUMENTS 1,452,116 A * 4/1923 Heue ..... E06B 1/6038 52/215
3,308,590 A * 3/1967 Ettore ..... E04F 13/085 52/281
3,828,495 A * 8/1974 Law ..... E04B 2/78 52/36.6
3,862,530 A * 1/1975 Martine ..... E04B 2/7854 52/281
4,117,644 A * 10/1978 Weinar ..... E04F 13/0844 52/363
4,221,095 A * 9/1980 Weinar ..... E04B 2/7457 52/281
4,281,494 A * 8/1981 Weinar ..... E04B 2/7411 52/346
4,296,580 A * 10/1981 Weinar ..... E04B 2/7457 52/281
4,333,286 A * 6/1982 Weinar ..... E04B 2/7457 52/281
4,370,838 A * 2/1983 Vermillion ..... E04F 13/0814 52/127.9
4,467,578 A * 8/1984 Weinar ..... E04B 2/7457 52/281
4,535,525 A * 8/1985 Varon ..... E04B 2/78 248/243
4,587,781 A * 5/1986 Uttley ..... E04B 9/008 52/242
4,713,922 A * 12/1987 Ingold ..... E06B 1/6069 254/104

(Continued)

FOREIGN PATENT DOCUMENTS

DE 102009057040 A1 * 6/2011 ..... E06B 1/6038
GB 2359845 A * 9/2001 ..... E06B 1/10
WO WO-2018076111 A1 * 5/2018 ..... E06B 1/6069

*Primary Examiner* — James M Ference

(57) ABSTRACT

A shimming device for attaching a substrate to a stud wall includes a plate, which has a first edge that is linear. The plate can be mounted to a respective opposed side of one of a plurality of studs to which the substrate is to be mounted. The plate is one of a plurality of plates that can be positioned on and mounted to the plurality of studs so that each plate is positioned at a respective support point for the substrate. Each plate is positioned with the first edge of the plate proud of an edge face of the stud and so that the first edges of the plurality of plates define a plane. The substrate, upon mounting to the plurality of studs, is parallel to the plane.

7 Claims, 5 Drawing Sheets

(56) References Cited

U.S. PATENT DOCUMENTS 4,731,965 A * 3/1988 Jensen ..... F16B 2/14 254/104
4,831,808 A * 5/1989 Wynar ..... E04B 9/245 52/281
4,982,540 A * 1/1991 Thompson ..... E04B 2/825 52/288.1
5,054,250 A * 10/1991 Foss ..... E06B 1/6069 52/126.1
5,243,797 A * 9/1993 Koenig, Jr. ..... E04F 13/06 52/254
5,345,739 A * 9/1994 Menchetti ..... E04B 2/7457 428/122
5,517,795 A * 5/1996 Doke ..... A47B 96/1416 248/243
5,561,955 A * 10/1996 Frobosilo ..... E06B 1/6069 49/468
5,655,343 A * 8/1997 Seals ..... E06B 1/603 49/505
5,953,862 A * 9/1999 Earhart ..... E04F 13/0853 52/98
6,018,916 A * 2/2000 Henry ..... E06B 1/6069 254/104
6,155,004 A * 12/2000 Earhart ..... E04F 13/0853 52/217
6,560,934 B1 * 5/2003 Workman ..... E06B 1/6069 248/188.2
8,443,556 B2 * 5/2013 Hiscock ..... E04B 1/7629 52/126.1
8,881,418 B2 * 11/2014 Funk ..... E04F 21/22 33/526
9,803,370 B2 * 10/2017 Robert ..... E04F 13/0832
10,246,886 B2 * 4/2019 Mitchell ..... E04F 21/0015
2010/0058678 A1 * 3/2010 Lutz ..... E06B 1/6069 52/126.1
2013/0263462 A1 * 10/2013 Funk ..... E04F 21/22 33/526
2015/0083873 A1 * 3/2015 Garpow ..... F16B 5/121 248/205.3
2019/0376282 A1 * 12/2019 Michel ..... E04B 2/7455

* cited by examiner

SHIMMING DEVICE AND METHOD OF USE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to shimming devices and more particularly pertains to a new shimming device for attaching a substrate to a stud wall.

(2) Description of Related Art Including Information Disclosed Under 37 CFR 1.97 and 1.98

The prior art relates to shimming devices. The prior art does not provide for the base features of the invention.

BRIEF SUMMARY OF THE INVENTION

An embodiment of the disclosure meets the needs presented above by generally comprising a plate, which has a first edge that is linear. The plate is configured to be mountable to a respective opposed side of one of a plurality of studs to which a substrate is to be mounted. The plate is one of a plurality of plates that is configured to be positioned on and mounted to the plurality of studs so that each plate is positioned at a respective support point for the substrate. Each plate is positioned with the first edge of the plate proud of an edge face of the stud and so that the first edges of the plurality of plates define a plane. The substrate, upon mounting to the plurality of studs, is parallel to the plane.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
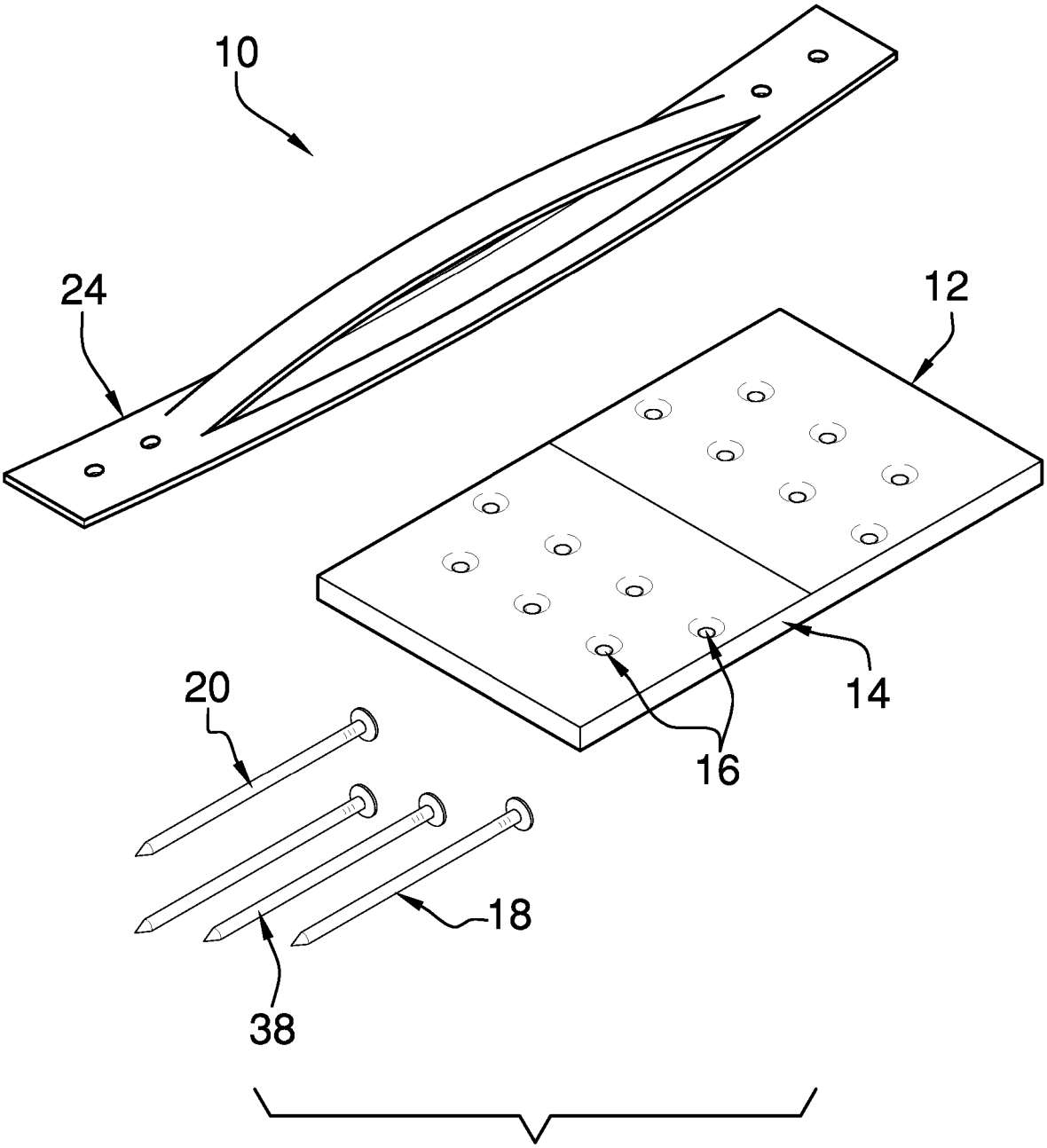
FIG. 1 is an isometric perspective view of a shimming device according to an embodiment of the disclosure.

With reference now to the drawings, and in particular to FIGS. 1 through 5 thereof, a new shimming device embodying the principles and concepts of an embodiment of the disclosure and generally designated by the reference numeral 10 will be described.

As best illustrated in FIGS. 1 through 5, the shimming device 10 generally comprises a plate 12, which has a first edge 14 that is linear. The plate 12 is configured to be mountable to a respective opposed side of one of a plurality of studs to which a substrate is to be mounted. The plate 12 has a plurality of holes 16 positioned therethrough. Respective holes 16 of the plurality of holes 16 are configured for insertion of mounting hardware 18 to affix the plate 12 to the stud.

Figure 2:
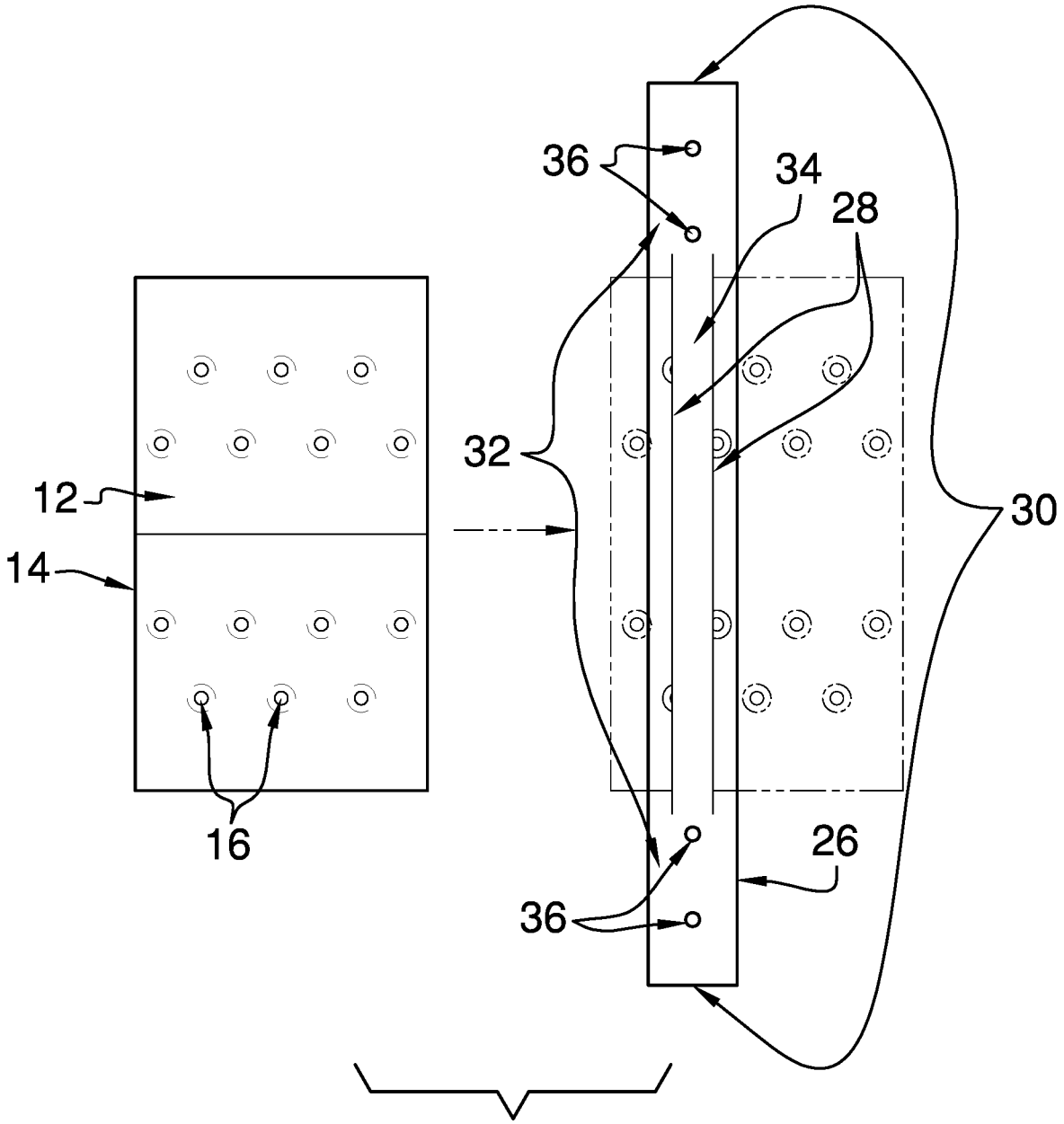
FIG. 2 is a front view of an embodiment of the disclosure.
Figure 3:
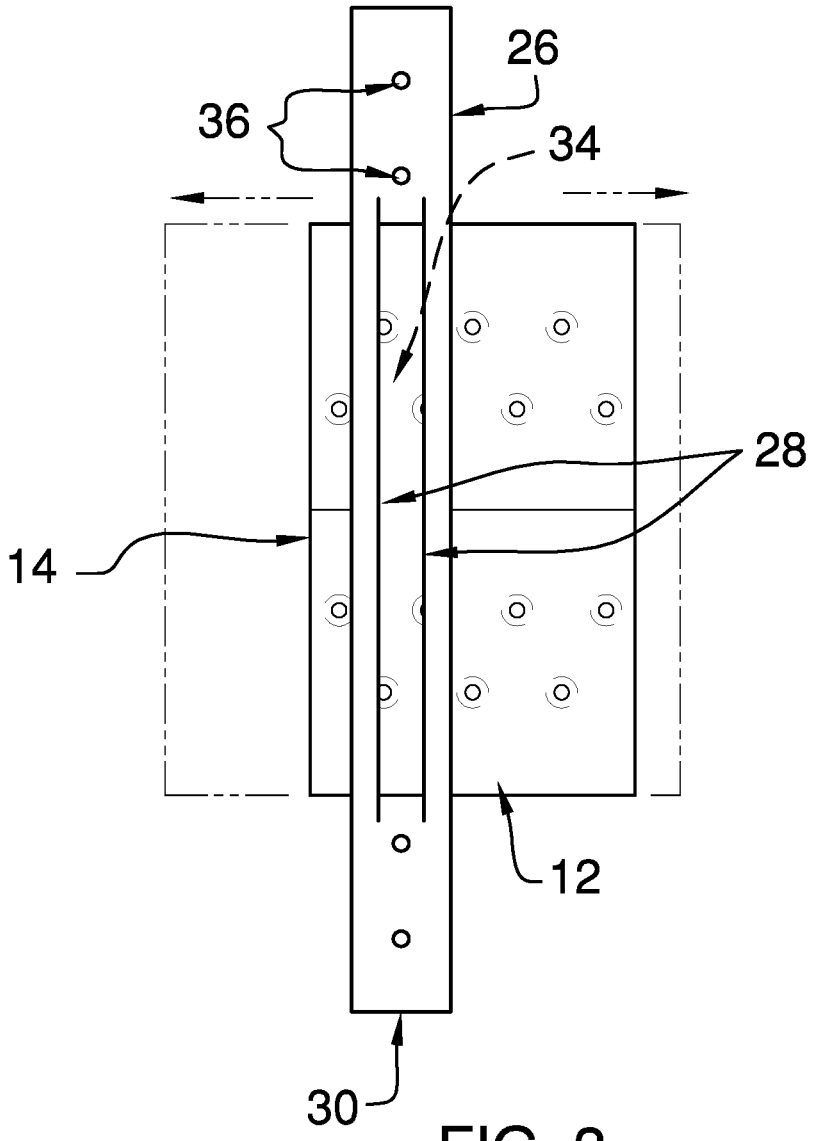
FIG. 3 is a back view of an embodiment of the disclosure.
Figure 4:
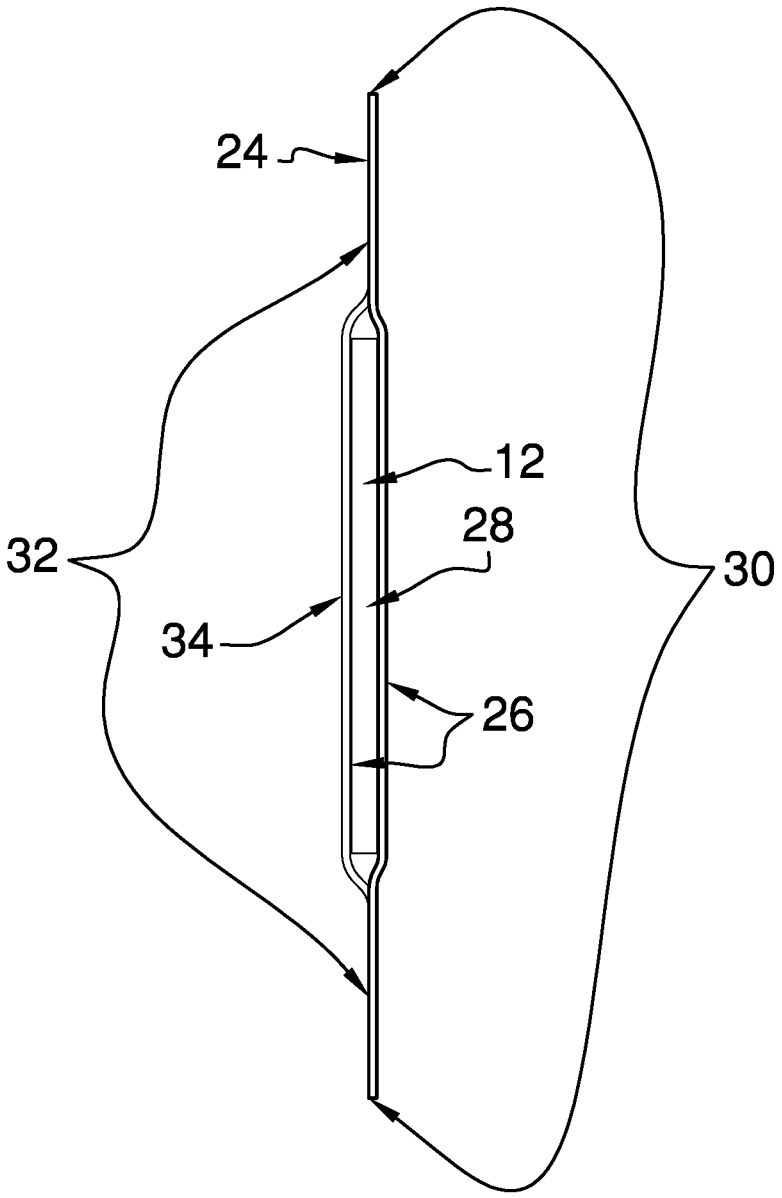
FIG. 4 is a side view of an embodiment of the disclosure.
Figure 5:
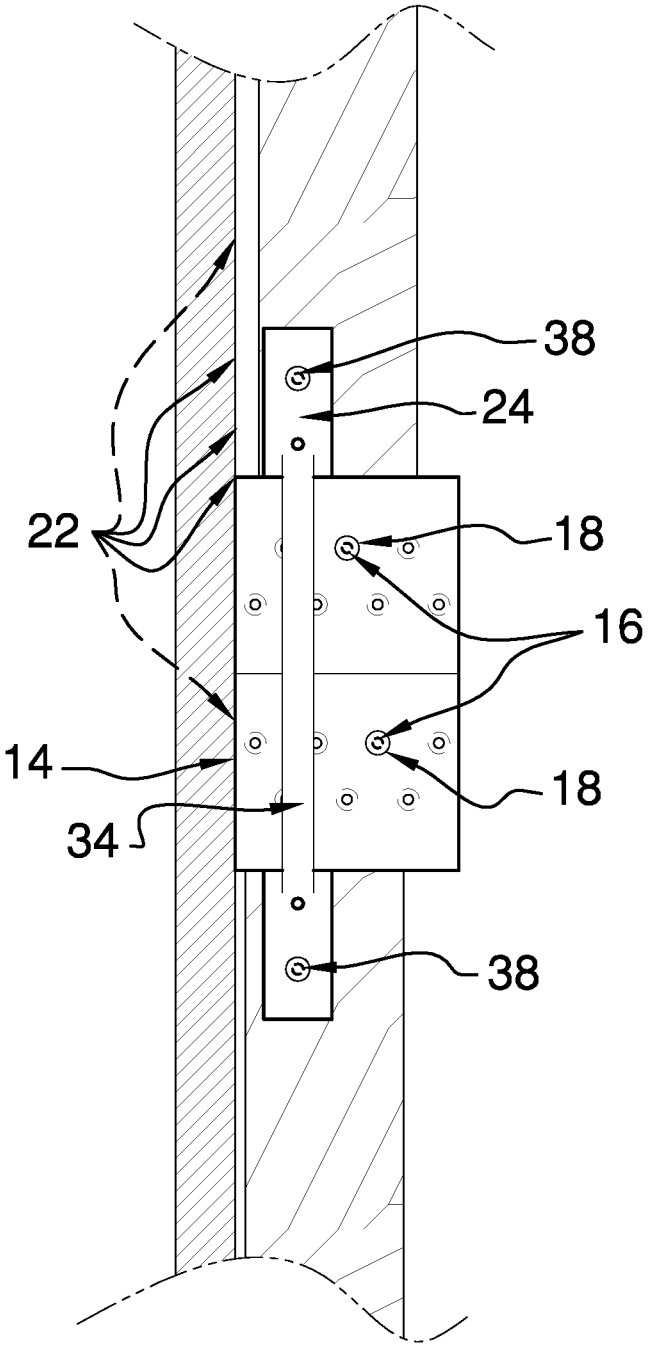
FIG. 5 is an in-use view of an embodiment of the disclosure.

The plate 12 may be substantially rectangularly shaped, as shown in FIG. 2, although the only limitations on shape of the plate 12 is that it is substantially planar and the first edge 14 is linear. The plate 12 comprises plastic, metal, or wood. The mounting hardware 18 may comprise a nail 20, as shown in FIG. 1, or other mounting means, such as, but not limited to, screws, adhesives, mortar, and the like.

The plate 12 is one of a plurality of plates 12 that is configured to be positioned on and mounted to the plurality of studs so that each plate 12 is positioned at a respective support point for the substrate. The substrate could be, for example, a sheet of drywall, a cabinet, subflooring, and the like. In the case of the substrate being a sheet of drywall, the support points could be proximate to each corner and spaced therebetween. Each plate 12 is positioned with the first edge 14 of the plate 12 proud of an edge face of the stud and so that the first edges 14 of the plurality of plates 12 define a plane 22. The substrate, upon mounting to the plurality of studs, is parallel to the plane 22.

In one embodiment, each plate 12 has a slide unit 24 slidably engaged thereto. The slide unit 24 is configured to be mountable to the respective opposed side of the stud. The plate 12 is slidable relative to the slide unit 24 and the stud to position the first edge 14 of the plate 12 proud of the edge face of the stud prior to mounting the plate 12 to the stud. The slide unit 24 allows a user to position multiple plates 12 and to assure that they define the plane 22 prior to mounting the plates 12 to the studs.

The slide unit 24 comprises a strap 26, which has a pair of slits 28 positioned therein. The slits 28 extends in parallel from proximate to opposed ends 30 of the strap 26 to define a pair of tabs 32 and a medial strip 34. The medial strip 34 is distensible so that the plate 12 is insertable through the pair of slits 28 to frictionally engage the plate 12 to the strap 26. Each tab 32 has a set of orifices 36 positioned therethrough. The orifices 36 are configured for insertion of a fasteners 38, such as nails and screws, to affix the strap 26 to the stud. The strap 26 comprises plastic or metal. The present invention anticipates the slide unit 24 comprising other sliding means, such as, but not limited to, a pair of Y-shaped tabs, a pair of rails, and the like.

The present invention includes a method of shimming a substrate for mounting to a plurality of studs. The method comprises the steps of:

1. providing a plurality of plates 12, each having a first edge 14 that is linear. The plate 12 is configured to be mountable to a respective opposed side of one of the plurality of studs to which the substrate is to be mounted, 2. positioning the plates 12 on the plurality of studs so that each plate 12 is positioned at a respective support point for the substrate, with the first edge 14 of the plate 12 proud of an edge face of the stud, 3. aligning the first edges 14 of the plurality of plates 12 so that the first edges 14 define a plane 22. For example, in mounting a sheet of drywall, a spirit level could be used to assure that the first edges 14 define a plane 22 that is vertical/plumb. A similar procedure would be used for installing a subfloor on uneven joists. The device 10 also can be used to position the sheet of drywall perpendicular to an adjoining wall, in an event the respective stud walls were installed off perpendicular. A square positioned across the first edges 14 of aligned plates 12 and the adjoining wall establishes the proper angle of the plane 22 relative to the adjoining wall.

4. mounting the plates 12 to the studs.

5. mounting the substrate to the plurality of studs.

When each plate 12 has a strip slidably engaged thereto, the method includes the steps of:

1. mounting the straps 26 to the studs, 2. inserting the plate 12 through the pair of slits 28 to frictionally engage the plate 12 to the strap 26, 3. sliding each plate 12 relative to an associated strap 26 and an associated stud to position the first edge 14 of the plate 12 proud of the edge face of the associated stud, 4. aligning the first edges 14 of the plurality of plates 12 so that the first edges 14 define a plane 22, 5. driving a nail 20 through each of the subset of holes 16 to affix the plate 12 to the stud, and 6. mounting the substrate to the plurality of studs.

In use, the strips are mounted to the studs proximate to the support points for the substrate. The plates 12 are inserted through the pairs of slits 28 to frictionally engage the plates 12 to the straps 26. Each plate 12 is slid relative to an associated slide unit 24 and an associated stud to position the first edge 14 of the plate 12 proud of the edge face of the associated stud. The first edges 14 of the plurality of plates 12 are aligned so that the first edges 14 define a plane 22, for example a plane 22 that is vertical. Nails 20 are driven through respective holes 16 to affix the plates 12 to the stud and the substrate then is mounted to the plurality of studs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A shimming device comprising:

a plate having a first edge, the first edge being linear, the plate being configured to be mountable to a respective opposed side of one of a plurality of studs to which a substrate is to be mounted; and the plate being one of a plurality of plates, wherein the plates are configured for positioning on and mounting to the plurality of studs such that each plate of the plurality of plates is positioned at a respective support point for the substrate, with the first edge of the plate proud of an edge face of the stud, and such that the first edges of the plurality of plates define a plane, such that the substrate, upon mounting to the plurality of studs, is parallel to the plane; and each plate of the plurality of plates having a slide unit slidably engaged thereto, the slide unit being configured to be mountable to the respective opposed side of the one of the plurality of studs to which the substrate is to be mounted, such that the plate is slidable relative to the slide unit and the stud for positioning the first edge of the plate proud of the edge face of the stud, wherein the slide unit comprises a strap, the strap having a pair of slits positioned therein, the slits extending in parallel from proximate to opposed ends of the strap defining a pair of tabs and a medial strip, the medial strip being distensible such that the plate is insertable through the pair of slits for frictionally engaging the plate to the strap, each tab of the pair of tabs having a set of orifices positioned therethrough, wherein the orifices are configured for insertion of fasteners for affixing the strap to the stud.

2. The shimming device of claim 1, further including the plate having a plurality of holes positioned therethrough, wherein respective holes of the plurality of holes are configured for insertion of mounting hardware for affixing the plate to the stud.

3. The shimming device of claim 2, wherein the mounting hardware comprises a nail.

4. The shimming device of claim 1, wherein each plate of the plurality of plates is substantially rectangularly shaped.

5. The shimming device of claim 1, wherein the plate comprises plastic, metal, or wood.

6. The shimming device of claim 1, wherein the strap comprises plastic or metal.

7. A shimming device comprising:

a plate having a first edge, the first edge being linear, the plate being configured to be mountable to a respective opposed side of one of a plurality of studs to which a substrate is to be mounted, the plate having a plurality of holes positioned therethrough, wherein respective holes of the plurality of holes are configured for insertion of mounting hardware for affixing the plate to the stud, the plate being substantially rectangularly shaped, the plate comprising plastic, metal, or wood, the mounting hardware comprising a nail;

the plate being one of a plurality of plates, wherein the plates are configured for positioning on and mounting to the plurality of studs such that each plate of the plurality of plates is positioned at a respective support point for the substrate, with the first edge of the plate proud of an edge face of the stud, and such that the first edges of the plurality of plates define a plane, such that the substrate, upon mounting to the plurality of studs, is parallel to the plane; and each plate of the plurality of plates having a slide unit slidably engaged thereto, the slide unit being configured to be mountable to the respective opposed side of the one of the plurality of studs to which the substrate is to be mounted, such that the plate is slidable relative to the slide unit and the stud for positioning the first edge of the plate proud of the edge face of the stud, the slide unit comprising a strap, the strap having a pair of slits positioned therein, the slits extending in parallel from proximate to opposed ends of the strap defining a pair of tabs and a medial strip, the medial strip being distensible such that the plate is insertable through the pair of slits for frictionally engaging the plate to the strap, each tab of the pair of tabs having a set of orifices positioned therethrough, wherein the orifices are configured for insertion of fasteners for affixing the strap to the stud, the strap comprising plastic or metal.

* * * * *